US011446737B2

(12) United States Patent
Maruyama et al.

(10) Patent No.: US 11,446,737 B2
(45) **Date of Patent: *Sep. 20, 2022**

(54) MOLDING DIE AND MOLDING METHOD

(71) Applicant: Diamet Corporation, Niigata (JP)

(72) Inventors: Tsuneo Maruyama, Niigata (JP); Yoshiki Tamura, Niigata (JP); Hideo Sakai, Niigata (JP)

(73) Assignee: Diamet Corporation, Niigata (JP)

( * ) Notice: Subject to any disclaimer, the term of this patent is extended or adjusted under 35 U.S.C. 154(b) by 102 days.

This patent is subject to a terminal disclaimer.

(21) Appl. No.: 16/306,349

(22) PCT Filed: Aug. 15, 2017

(86) PCT No.: PCT/JP2017/029386

§ 371 (c)(1),
(2) Date: Nov. 30, 2018

(87) PCT Pub. No.: WO2018/034288

PCT Pub. Date: Feb. 22, 2018

(65) Prior Publication Data

US 2019/0344349 A1 Nov. 14, 2019

(30) Foreign Application Priority Data

Aug. 18, 2016 (JP) ..... JP2016-160554

(51) Int. Cl.
*B22F 5/10* (2006.01)
*B30B 11/02* (2006.01)
*B22F 3/03* (2006.01)

(52) U.S. Cl.
CPC ..... *B22F 5/10* (2013.01); *B30B 11/027* (2013.01); *B22F 2003/033* (2013.01)

(58) Field of Classification Search
CPC ..... B30B 11/027; B22F 2003/033
See application file for complete search history.

(56) References Cited

U.S. PATENT DOCUMENTS 3,615,382 A * 10/1971 Manilla ..... B22F 5/106 419/38
4,087,221 A 5/1978 Munson et al.
(Continued)

FOREIGN PATENT DOCUMENTS

CN 2877916 Y 3/2007
CN 202291399 U 7/2012
(Continued)

OTHER PUBLICATIONS

International Search Report dated Sep. 12, 2017 for the corresponding PCT International Patent Application No. PCT/JP2017/029386.
(Continued)

*Primary Examiner* — Alison L Hindenlang
*Assistant Examiner* — Asha A Thomas
(74) *Attorney, Agent, or Firm* — Leason Ellis LLP

(57) ABSTRACT

The molding die of the invention includes: a first die having a through-hole; a second die inserted into the through-hole and capable of moving relative to the first die; and a first punch and a second punch each insertable into the through-hole. A cavity surrounded by the second die, the first punch, and the second punch to compression-mold a molding object is formed in the through-hole. An undercut molding part is formed in the surface of the second die facing the cavity. The second die is formed so as to be splittable into two or more split bodies.

8 Claims, 12 Drawing Sheets

(56) References Cited

U.S. PATENT DOCUMENTS

| | | | | |
|---|---|---|---|---|
| 5,378,416 | A | 1/1995 | Kishi et al. | |
| 5,503,795 | A | 4/1996 | Hubbard | |
| 8,062,014 | B2 | 11/2011 | Gubanich | |
| 8,210,749 | B2 * | 7/2012 | Mandel | B30B 11/027 384/434 |
| 2008/0298996 | A1 | 12/2008 | Kuplen et al. | |
| 2012/0107444 | A1 | 5/2012 | Murasugi et al. | |
| 2012/0121362 | A1 | 5/2012 | Taylor et al. | |

FOREIGN PATENT DOCUMENTS

| | | | |
|---|---|---|---|
| CN | 104014787 | A | 9/2014 |
| CN | 205008573 | U | 2/2016 |
| JP | 48059085 | A | 8/1973 |
| JP | 51149106 | A | 12/1976 |
| JP | 52008551 | B | 3/1977 |
| JP | 59043106 | U | 3/1984 |
| JP | 01-100206 | A | 4/1989 |
| JP | 02-085304 | A | 3/1990 |
| JP | 05-302102 | A | 11/1993 |
| JP | 06-039596 | A | 2/1994 |
| JP | 08-020807 | A | 1/1996 |
| JP | 11-192596 | A | 7/1999 |
| JP | 2003193113 | A | 7/2003 |
| JP | 2004298917 | A | 10/2004 |
| JP | 2009-068558 | A | 4/2009 |
| JP | 2010-031331 | A | 2/2010 |
| SU | 1041209 | A1 | 9/1983 |
| WO | WO-95/14567 | A1 | 6/1995 |
| WO | WO-95/14568 | A1 | 6/1995 |
| WO | WO-01/74519 | A1 | 10/2001 |
| WO | WO-03/008131 | A2 | 1/2003 |
| WO | WO-03/061882 | A1 | 7/2003 |
| WO | WO-2015/140228 | A1 | 9/2015 |
| WO | WO-2015/189300 | A1 | 12/2015 |

OTHER PUBLICATIONS

Japanese Office Action dated Jun. 16, 2020 for the corresponding Japanese Patent Application No. 2016-160554.

Chinese Office Action dated Mar. 26, 2020 for the corresponding Chinese Patent Application No. 201780031157.2.

European Search Report dated Dec. 2, 2019 for the corresponding European Patent Application No. 17841510.5.

Chinese Office Action dated Sep. 30, 2019 for the related Chinese Patent Application No. 201780008168.9.

International Search Report dated May 30, 2017 for the related PCT Application No. PCT/JP2017/008504.

Extended European Search Report dated Oct. 10, 2019 for the related European Patent Application No. 17763115.7.

Non-Final Office Action dated Apr. 2, 2020 for the related U.S. Appl. No. 16/081,723.

* cited by examiner

MOLDING DIE AND MOLDING METHOD

CROSS-REFERENCE TO RELATED PATENT APPLICATIONS

This application is a U.S. National Phase application under 35 U.S.C. § 371 of International Patent Application No. PCT/JP2017/029386, filed Aug. 15, 2017, and claims the benefit of Japanese Patent Application No. 2016-160554, filed on Aug. 18, 2016, all of which are incorporated herein by reference in their entirety. The International Application was published in Japanese on Feb. 22, 2018 as International Publication No. WO/2018/034288 under PCT Article 21(2).

FIELD OF THE INVENTION

The present invention relates to a molding die, and a molding method using the same.

BACKGROUND OF THE INVENTION

For example, a method of manufacturing high-accuracy components or the like is known (for example, refer to: Japanese Unexamined Publication No. 2009-68558), and the method includes: performing die molding by using a powder material such as metal powder, ceramic powder, and the like as a molding object; and sintering the obtained green compact (molded body) at a high temperature. Generally, the powder molding die consists of a die in which a through-hole is formed between two facing openings, and an upper punch and a lower punch that are respectively inserted into the cavity from one opening and the other opening of the die.

In the power molding die having such a configuration, for example, raw material powder is filled into the cavity in a state where the lower punch is fitted into the cavity from the opening on the other side (lower side) of the die. Next, inserting the upper punch is inserted into the cavity from the opening on one side (upper side) of the die and the raw material powder is pressed into the cavity between the upper punch and the lower punch; and thereby, a green compact that imitates the shape of the cavity is formed. Next, one punch is separated from any opening of the die, and then the other punch pushes out the green compact molded within the cavity. Accordingly, the green compact can be extracted (released) from the inside of the cavity.

Meanwhile, in the case where a molded body including an undercut shape, such as a projection or a groove, which extends in a direction intersecting an insertion/removal direction of the upper punch and the lower punch, is molded as a green compact (molded body), a molding method of inserting a splittable second die into the through-hole of the die to perform molding is known.

For example, in the powder molding method disclosed in Japanese Unexamined Publication No. H01-100206, a swelling part (undercut shape) is formed within the through-hole of the outer mold (die), and the coupling die (second die) splittable into two split bodies is inserted into the through-hole.

Next, the powder filled into the cavity of the coupling die is compressed with the upper punch and the lower punch to form a green compact, and then the coupling die is extracted from the die, and the coupling die is split; and thereby, a green compact including the undercut shape is obtained.

Problems to be Solved by the Invention

However, in the powder molding method described in Japanese Unexamined Publication No. H01-100206, a structure is adopted in which the coupling die is inserted into the through-hole of the outer die (die), and then, the upper punch is inserted into the coupling die to compress the molding object. Therefore, the molding position of the undercut shape part in the obtained molded body is likely to deviate, that is, the coupling die is inserted into the through-hole of the outer die (die), and the molding object is introduced into the cavity of the coupling die, and then, the upper punch is inserted into the cavity and compressed. Therefore, in the case of the molding object with a high compression rate, there is a problem that the upper punch enters the cavity more deeply and the molding position of the undercut shape part in a height direction of the molded body is likely to deviate.

The invention has been made in view of the above-described circumstances, and an object thereof is to provide a molding die capable of molding an undercut shape part without any positional deviation and with high accuracy, and a molding method using this molding die.

SUMMARY OF THE INVENTION

Solutions for Solving the Problems

A molding die that is an aspect of the invention has the following configuration.

A molding die includes: a first die having a through-hole; a second die inserted into the through-hole and capable of moving relative to the first die; and a first punch and a second punch each insertable into the through-hole. A cavity surrounded by the second die, the first punch, and the second punch to compression-mold a molding object is formed in the through-hole. An undercut molding part is formed in the surface of the second die facing the cavity. The second die is formed so as to be splittable into two or more split bodies.

According to the molding die that is the aspect of the invention, the molding die has a structure in which the molding object is introduced into the through-hole of the first die in advance and then, the second die is insertable into the through-hole of the first die in a state where the second die is attached to the first punch. Thus, it is possible to realize the molding die capable of molding the undercut shape part in the molded body without any positional deviation and with high accuracy irrespective of the compression rate of the molding object.

The molding die that is the aspect of the invention further includes a third punch outside the second punch, and the third punch is movable relative to the second punch and is insertable into and removable from the through-hole so as to be in contact with the second die at a tip thereof and in contact with an inner surface of the through-hole, outside the second punch.

The molding die that is the aspect of the invention further includes a core rod insertable into the cavity.

In the molding die of the invention, the molding object is powder.

A molding method that is another aspect of the invention has the following configuration.

A molding method using the molding die as described above is provided. The molding method includes at least an introduction step of introducing the molding object into the through-hole in a state where the second punch is inserted in an insertion/removal direction from one side of the through-hole; an insertion step of simultaneously inserting the first punch and the second die from the other side of the through-hole; a compression step of bringing the first punch and the second punch close to each other to compression-mold the molding object within the cavity to mold a molded body; and an extraction step of extracting the molded body from the molding die.

According to the molding method that is the aspect of the invention, the molding object is introduced into the through-hole of the first die in advance and then, the second die is inserted into the through-hole of the first die to compress the molding object in a state where the second die is attached to the first punch. Thereby, it is possible to realize the molding method capable of molding the undercut shape part in the molded body without any positional deviation and with high accuracy irrespective of the compression rate of the molding object.

In the molding method that is the aspect of the invention, the extraction step is a step of pulling out the first punch, the second die, and the molded body from the through-hole, and then splitting the second die in a direction intersecting the insertion/removal direction to remove the molded body from the second die.

Effects of the Invention

According to the invention, it is possible to provide a molding die capable of molding the undercut shape part in the molded body without any positional deviation and with high accuracy, and a molding method using this molding die.

DETAILED DESCRIPTION OF THE INVENTION

Figure 1:
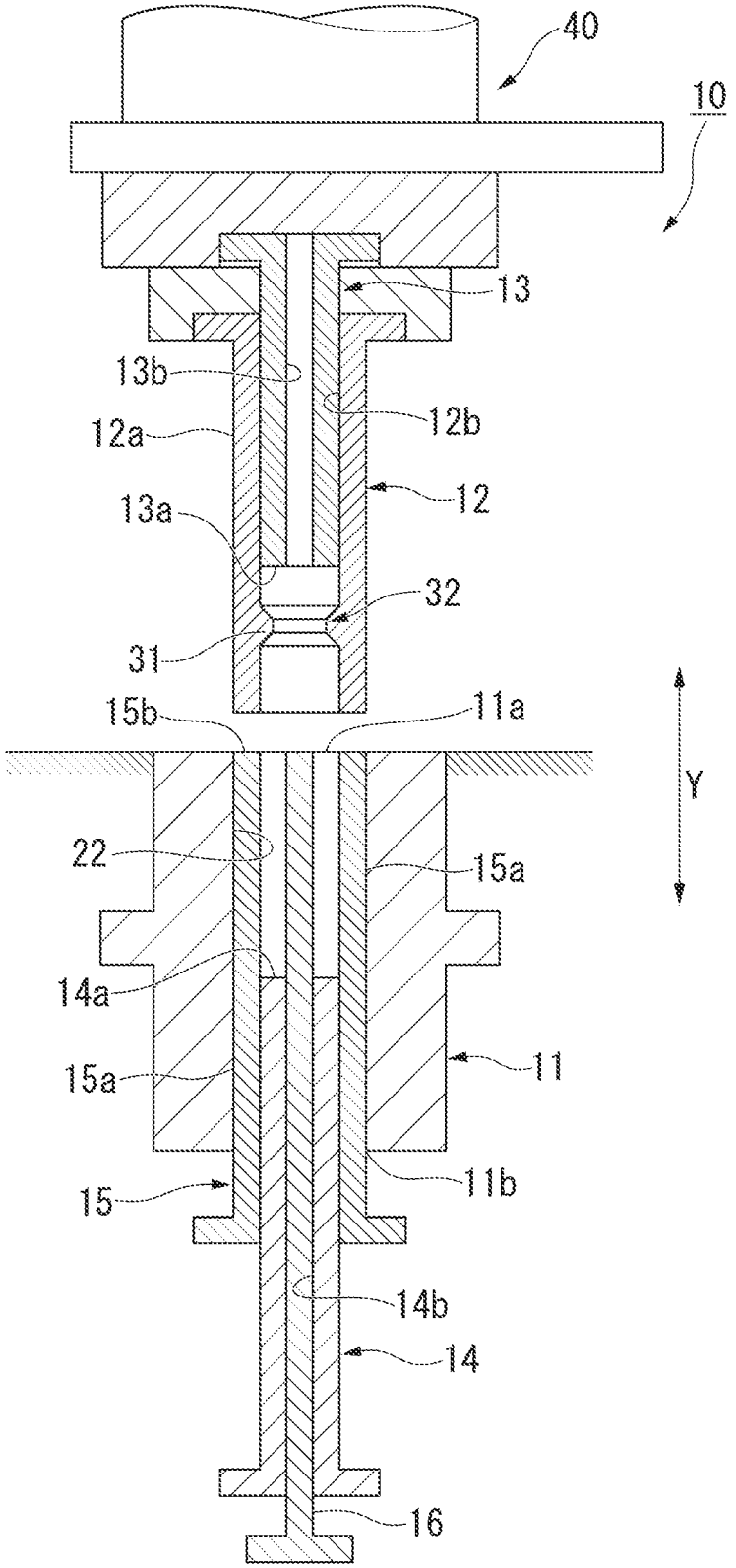
FIG. 1 is a side sectional view of a molding die in an insertion/removal direction (compression direction).

Hereinafter, a molding die and a molding method, which are embodiments to which the invention is applied, will be described with reference to the drawings. In addition, an embodiment shown below will be specifically described in order to make the purpose of the invention better understood, and does not limit the invention unless otherwise specified. Additionally, in the drawings to be used in the following description, major portions may be shown in an enlarged manner for convenience in order to make the features of the invention easily understood, and the dimension scales or the like of respective constituent elements are not necessarily the same as actual dimension scales.

Figure 2:
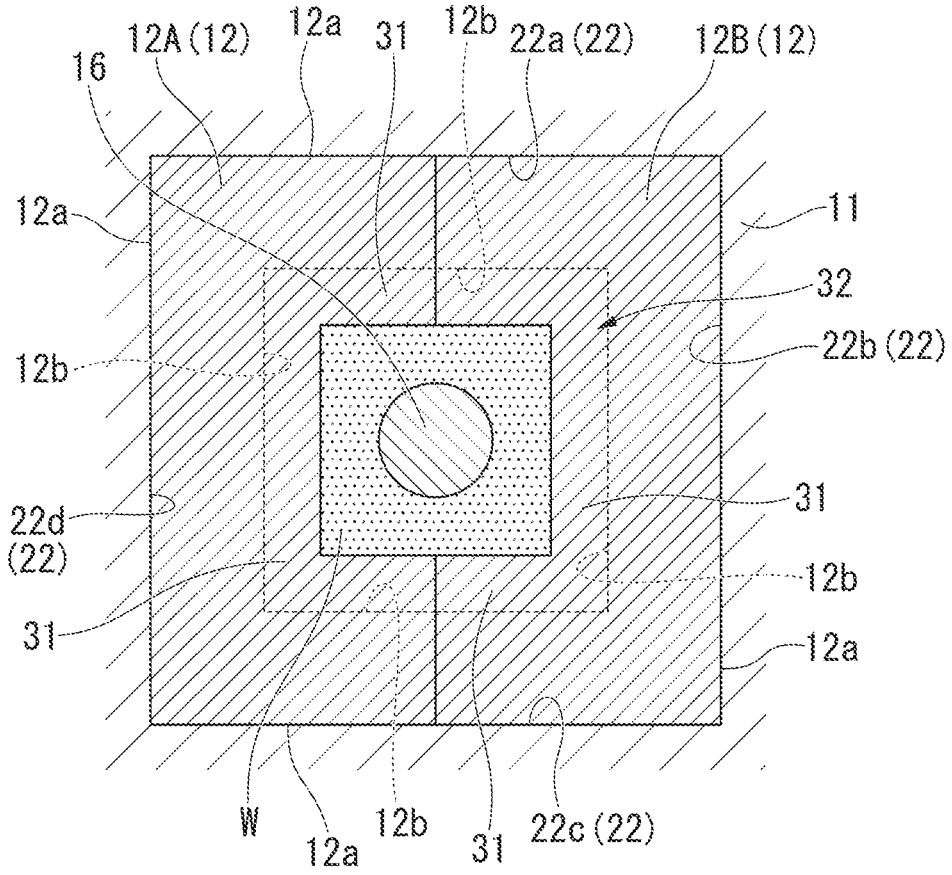
FIG. 2 is a sectional view of the molding die as seen from above.

FIG. 1 is a side sectional view in an insertion/removal direction (compression direction) of the molding die related to the embodiment of the invention. Additionally, FIG. 2 is a sectional view as seen from line A-A' of FIG. 3. In addition, in the following description, the insertion/removal direction Y indicates a compression direction with respect to a cavity P obtained by a second die 12, a first punch 13, and a second punch 14 to be described below.

A molding die 10 of the present embodiment is, for example, a die for forming a green compact which is an example of a molded body through compression molding using powder as an example of a molding object.

The molding die 10 includes a first die 11, the second die 12 that is insertable and removable from the first die 11, the first punch 13, the second punch 14, a third punch 15, and a core rod 16.

The first die 11 has, for example, an outer shape of a substantially cylindrical shape, and has a through-hole 22 penetrating between one opening 11*a* and the other opening 11*b* formed therein. In the present embodiment, the through-hole 22 forms a rectangular parallelepiped space surrounded by four inner surfaces 22*a* to 22*d*.

The second die 12 is a hollow angular tubular member that is formed so as to be insertable into and removable from the through-hole 22 of the first die 11 and has an outer shape of substantially rectangular parallelepiped shape. An outer surface 12*a* of the second die 12 is brought into close contact with the inner surfaces 22*a* to 22*d* which form the through-hole 22 of the first die 11 during molding. The second die 12 includes second-die split bodies 12A and 12B that are two split bodies capable of being split from each other. Contact portions of the second-die split bodies 12A and 12B are brought into close contact with each other without a gap by combining the second-die split bodies 12A and 12B with each other and inserting the second-die split bodies 12A and 12B into the through-hole 22 of the first die 11. In the present embodiment, the second die 12 includes the second-die split bodies 12A and 12B that faces each other and have a U-shaped cross-section.

An undercut molding part 32 including an alternate projection and depression 31 extending in a direction intersecting the insertion/removal direction Y is formed in an inner wall surface 12*b* of the second die 12 that constitutes the cavity P. In the present embodiment, a projection, which protrudes toward a central direction of the cavity P and a trapezoidal cross-section, is formed as the alternate projection and depression 31 so as to surround four inner wall surfaces 12*b* of the second die 12. This undercut molding part 32 gives an undercut shape to the green compact in the molding method to be described below.

In addition, the alternate projection and depression 31 extending in the direction intersecting the insertion/removal direction Y means a shape portion that protrudes or is indented in a direction having an angle with respect to the insertion/removal direction Y, and the number of these alternate projections and depressions, the shapes, combinations, and arrangements of the respective alternate projections and depressions are not limited.

The first punch 13 is a quadrangular prismatic member that is formed so as to be insertable into and removable from the second die 12 and has a rectangular cross-section. A pressing surface 13*a* of the first punch 13 compresses the molding object in the insertion/removal direction Y from one opening 11*a* side of the first die 11 during molding. A through-hole 13*b* having a round cross-section is formed at a cross-sectional center portion in this first punch 13. The core rod 16 to be described below is made to be insertable into and removable from the through-hole 13*b*. During molding, the first punch 13 is inserted in the through-hole 22 of the first die 11 in a state where the first punch 13 is immovable with respect to the inner wall surface 12*b* of the second die 12. Thereby, the first punch and the second die can be inserted into the through-hole 22 of the first die 11 while keeping the distance from the pressing surface 13*a* of the first punch 13 to the undercut molding part 32 constant, and the undercut shape part 32 can be molded in the molded body without any positional deviation and with high accuracy.

The second punch 14 is a quadrangular prismatic member that is formed so as to be insertable into and removable from a hollow portion of the third punch 15 to be described below and has a rectangular cross-section. A pressing surface 14*a* of the second punch 14 compresses the molding object in the insertion/removal direction Y from the other opening 11*b* side of the first die 11 during molding.

A through-hole 14*b* having a round cross-section is formed at a cross-sectional center portion in this second punch 14. The through-hole 14*b* is coaxially formed with the same diameter as that of the through-hole 13*b* of the first punch 13, and a portion of the core rod 16 to be described below is made to be insertable into and removable from the through-hole 14*b*.

The third punch 15 is a hollow angular tubular member that is formed so as to be insertable into and removable from the through-hole 22 of the first die 11 and has an outer shape of a substantially rectangular parallelepiped shape. An outer surface 15*a* of the third punch 15 is in contact with the inner surfaces 22*a* to 22*d* which forms the through-hole 22 of the first die 11 during molding. A tip 15*b* of the third punch 15 is in contact with a lower end of the second die 12 in a state where the third punch 15 is inserted into the through-hole 22 of the first die 11. Thereby, the second die 12 can be, for example, raised by moving the third punch 15 with respect to the first die 11. Additionally, the second punch 14 mentioned above is made to be insertable into and removable from a hollow portion of the third punch 15.

The core rod 16 is, for example, a cylindrical rod-like member, and is insertably and removably disposed so as to pass through the cavity P from the through-hole 14*b* of the second punch 14 toward the through-hole 13*b* of the first punch 13. This core rod 16 forms a through-hole having a round cross-section in the green compact molded within the cavity P.

Figure 3:
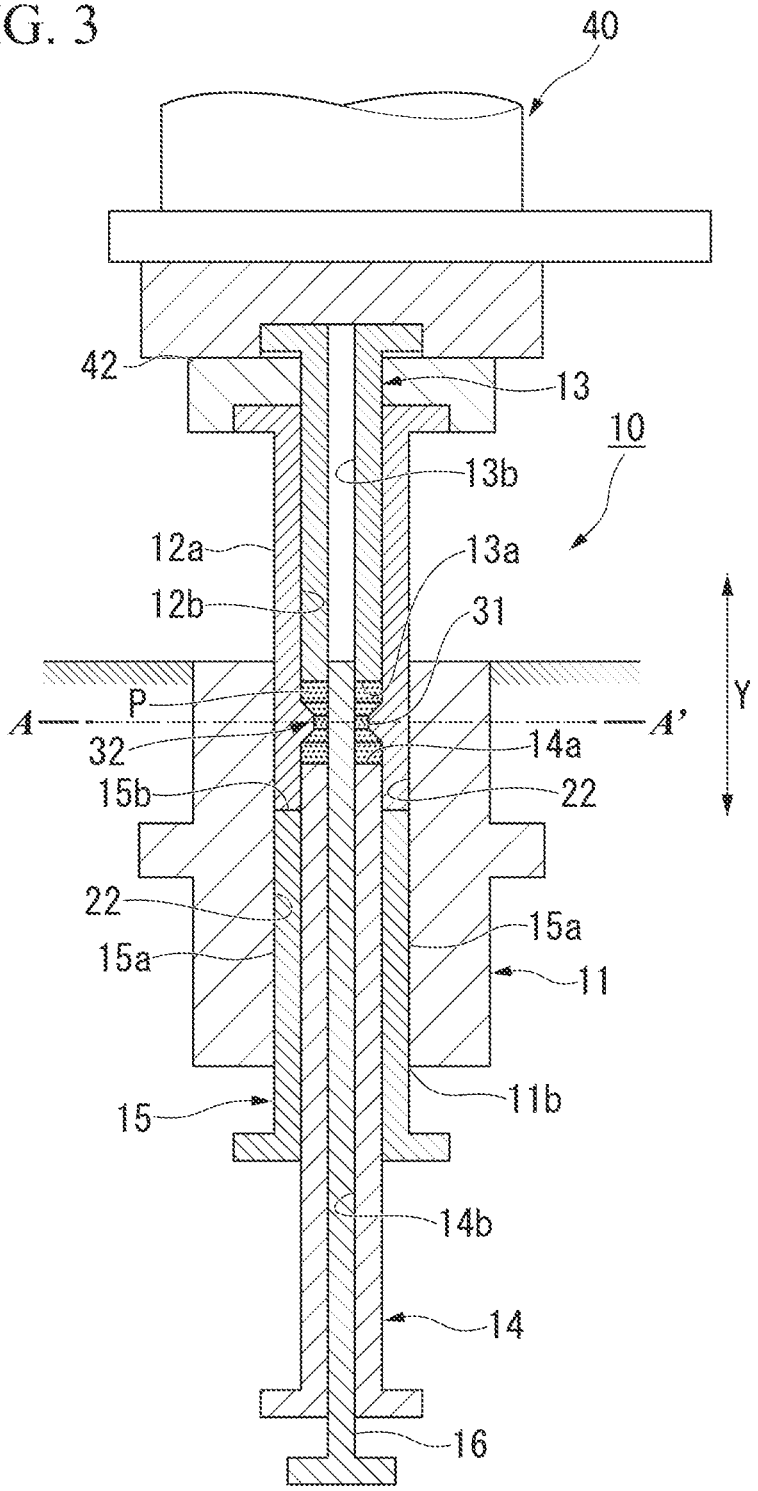
FIG. 3 is a side sectional view of the molding die shown in FIG. 1 during molding.
Figure 4:
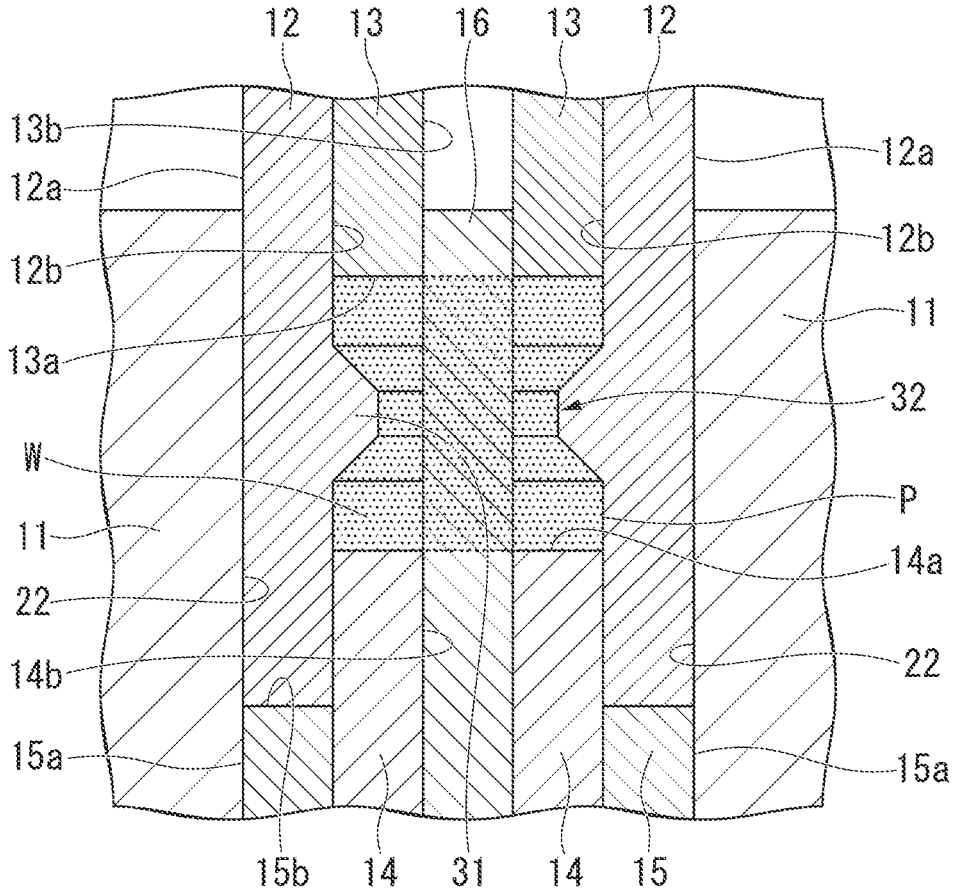
FIG. 4 is an enlarged sectional view of main parts showing a cavity of the molding die of FIG. 3 and its peripheral portion.

FIG. 3 is a side sectional view of the molding die shown in FIG. 1 during molding. Additionally, FIG. 4 is an enlarged sectional view of main parts showing the cavity P of FIG. 3 and its peripheral portion.

During molding of the molding object, the cavity P surrounded by the second die 12, the first punch 13, and the second punch 14 is formed within the through-hole 22 of the first die 11. More specifically, the cavity P is a molding space that is surrounded by the inner wall surface 12*b* of the second die 12, the pressing surface 13*a* of the first punch 13, and the pressing surface 14*a* of the second punch 14 and has a substantially rectangular parallelepiped shape.

The second die 12 covers the inner surfaces 22*a* to 22*d* that form the through-hole 22 of the first die 11. Accordingly, the inner surfaces 22*a* to 22*d* that form the through-hole 22 are not exposed to the cavity P. The undercut molding part 32 is formed in the inner wall surface 12*b* of the second die 12 that faces the cavity P. Additionally, the core rod 16 passes through a central portion of the cavity P in the insertion/removal direction Y.

In such a molding die 10, during molding, the cavity P is filled with powder W that is the molding object, the first punch 13 is moved toward the second punch 14 by a pressing mechanism 40 including a hydraulic device and the like, the height in the insertion/removal direction Y of the cavity P is reduced, the powder W that is the molding object is compressed, and the green compact that imitates the shape of the cavity P is molded.

Figure 5:
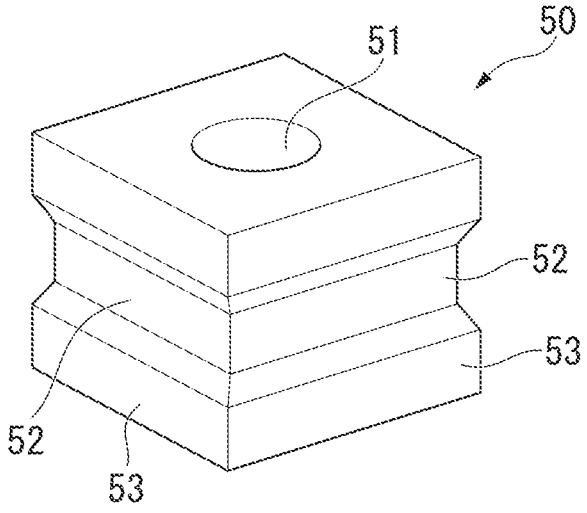
FIG. 5 is an external perspective view showing an example of the shape of a molded body.

FIG. 5 is an external perspective view showing an example of the green compact (molded body) formed using the molding die 10 having such a configuration. The green compact 50 has a substantially rectangular parallelepiped shape, and the center thereof is provided with a through-hole 51 that is molded by the core rod 16 (refer to FIGS. 1 and 2) and has a round cross-section. Additionally, a groove (undercut shape part) 52, which is molded by the alternate projection and depression 31 (refer to FIGS. 1 and 2) forming the undercut molding part 32 and has a substantially trapezoidal cross-section, is formed over the entire circumference of four side surfaces 53 of the green compact 50 on one surface of the green compact 50. This groove 52 is an undercut shape part extending in the direction intersecting the insertion/removal direction Y during molding of the green compact 50.

The molding method of the invention using the molding die having the above configurations will be described. FIG. 6A, FIG. 6B, FIG. 6C, FIG. 7A, and FIG. 7B are side sectional views showing the molding method of the invention step by step. In addition, top sectional views of the molding die as seen from above are also shown at upper parts of FIG. 7A and FIG. 7B.

Figure 6A:
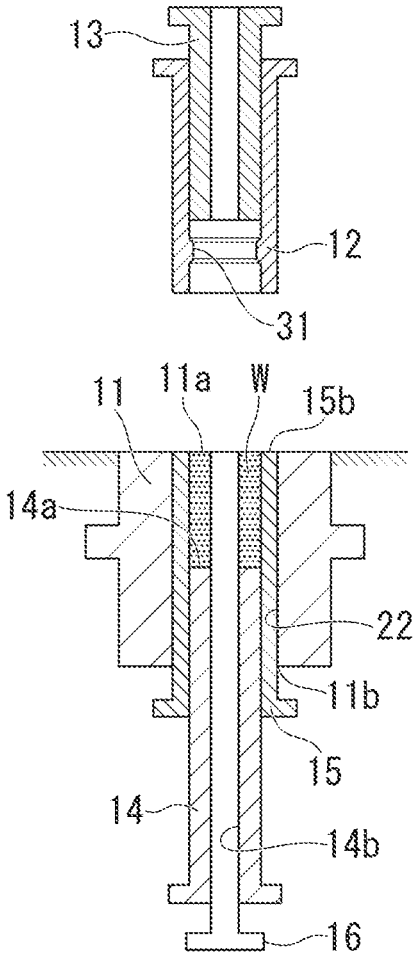
FIG. 6A is a side sectional view showing a molding method related to an embodiment of the invention.

For example, in the case where the green compact 50 having the groove 52 that is the undercut shape part is molded at the entire circumference of a side surface as shown in FIG. 5 by the molding method of the invention, first, as shown in FIG. 6A, the third punch 15 is inserted into the through-hole 22 from the other opening 11*b* of the first die 11, and the second punch 14 is further inserted into the hollow portion of the third punch 15. At this time, the pressing surface 14*a* of the second punch 14 is at a position lower than the tip 15*b* of the third punch 15 in the insertion/removal direction Y. Additionally, the core rod 16 is inserted into the through-hole 14*b* of the second punch 14.

Next, the powder W that is an example of the molding object is introduced into the through-hole 22 of the first die 11 (into the third punch 15 inserted into the through-hole 22). The powder W is introduced into the hollow portion of the third punch 15 before molding. Examples of the powder W to be introduced includes iron powder and copper power including metals as main components, mixed powder thereof, and the like.

Figure 6B:
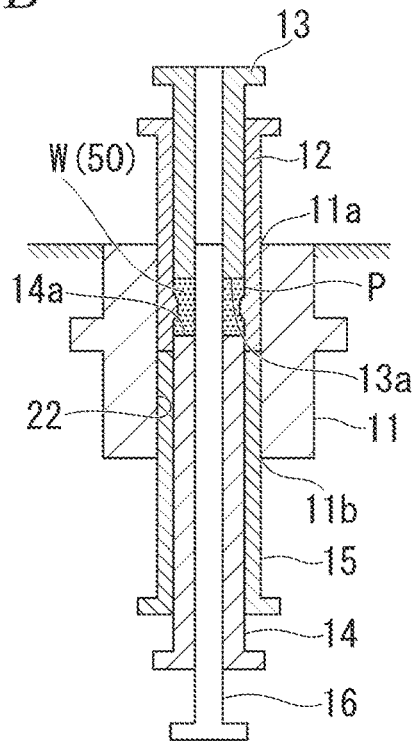
FIG. 6B is a side sectional view showing the molding method related to the embodiment of the invention.

Next, as shown in FIG. 6B, the pressing mechanism 40 (refer to FIG. 3) is actuated to lower the first punch 13 where the first punch 13 is fitted into the second die 12, and the first punch 13 and the second die 12 are simultaneously inserted into the through-hole 22 from the opening 11*a* of the first die 11. Accordingly, the powder W is filled into the cavity P surrounded by the inner wall surface 12*b* of the second die 12, the pressing surface 13*a* of the first punch 13, and the pressing surface 14*a* of the second punch 14 (molding object filling step). Additionally, the second-die split body 12A and the second-die split body 12B that constitute the second die 12 are combined with each other and the combined second-die split bodies are inserted into the through-hole 22 of the first die 11; and thereby, split portions of the second-die split body 12A and the second-die split body 12B are brought into close contact with each other without a gap.

The first punch 13 is further lowered toward the second punch 14 by the pressing mechanism 40 (refer to FIG. 3), and a gap between the pressing surface 13*a* of the first punch 13 and the pressing surfaces 14*a* of the second punch 14 is narrowed to compress the powder W (compression step). Through the compression step, the powder W is compressed within the cavity P, and the green compact (molded body) 50 including the groove 52 (refer to FIG. 5) that forms the undercut shape part imitating the internal shape of the cavity P, and the through-hole 51 (refer to FIG. 5) that imitates the core rod 16 is compression-molded.

When the powder W is compressed, the compressed powder is pressed against the undercut molding part 32 (refer to FIG. 4) of the second die 12, and the alternate projection and depression 31 (refer to FIG. 4) extending in the direction intersecting the insertion/removal direction Y and having a trapezoidal cross-section are transferred. Accordingly, the groove 52, which is the undercut shape part having a trapezoidal cross-section, is formed in the green compact (molded body) 50 so that the groove 52 surrounds the entire circumference of the side surface of the green compact 50.

Figure 6C:
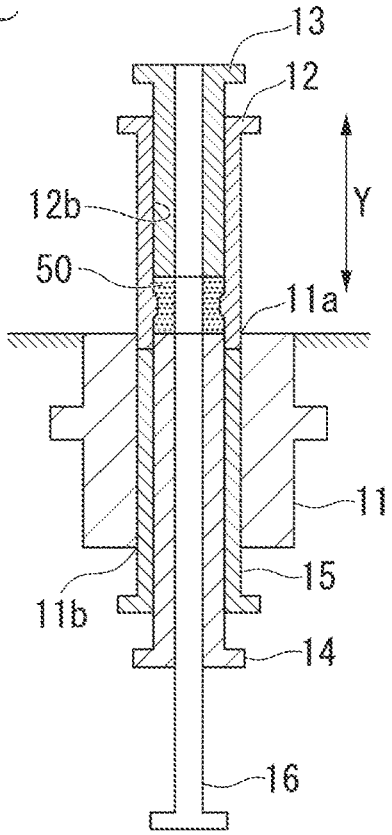
FIG. 6C is a side sectional view showing the molding method related to the embodiment of the invention.

Next, after the molding of the green compact (molded body) 50 is completed, as shown in FIG. 6C, the second punch 14, the third punch 15, and the second die 12 and the first punch 13 that hold the green compact 50 are extracted from the through-hole 22 of the first die 11 (extraction step). In such an extraction step, the green compact 50 is held by the inner wall surface 12*b* of the second die 12.

Figure 7A:
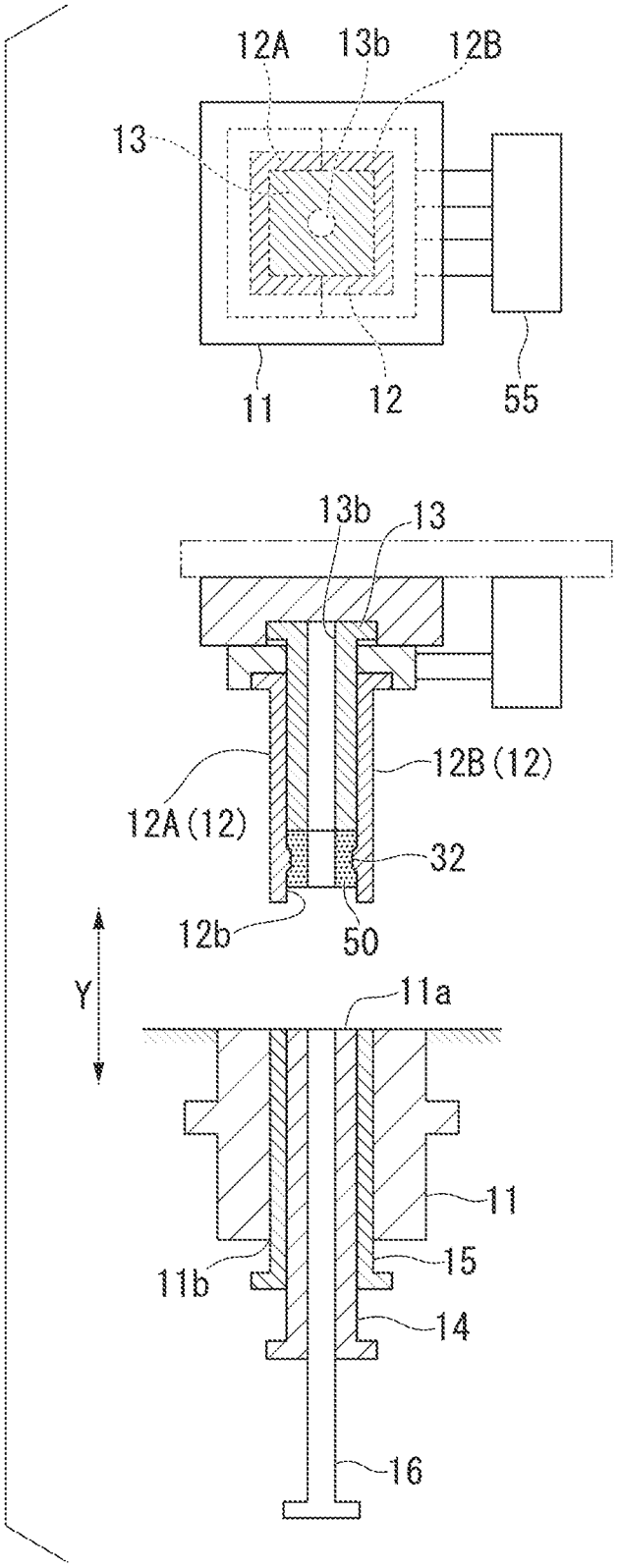
FIG. 7A is a side sectional view and a top sectional view showing the molding method related to the embodiment of the invention.

As shown in FIG. 7A, the second die 12 and the first punch 13 that hold the green compact 50 are completely extracted from the through-hole 22 of the first die 11. In this state, the green compact 50 is in a state where the groove 52 is engaged with the undercut molding part 32.

Figure 7B:
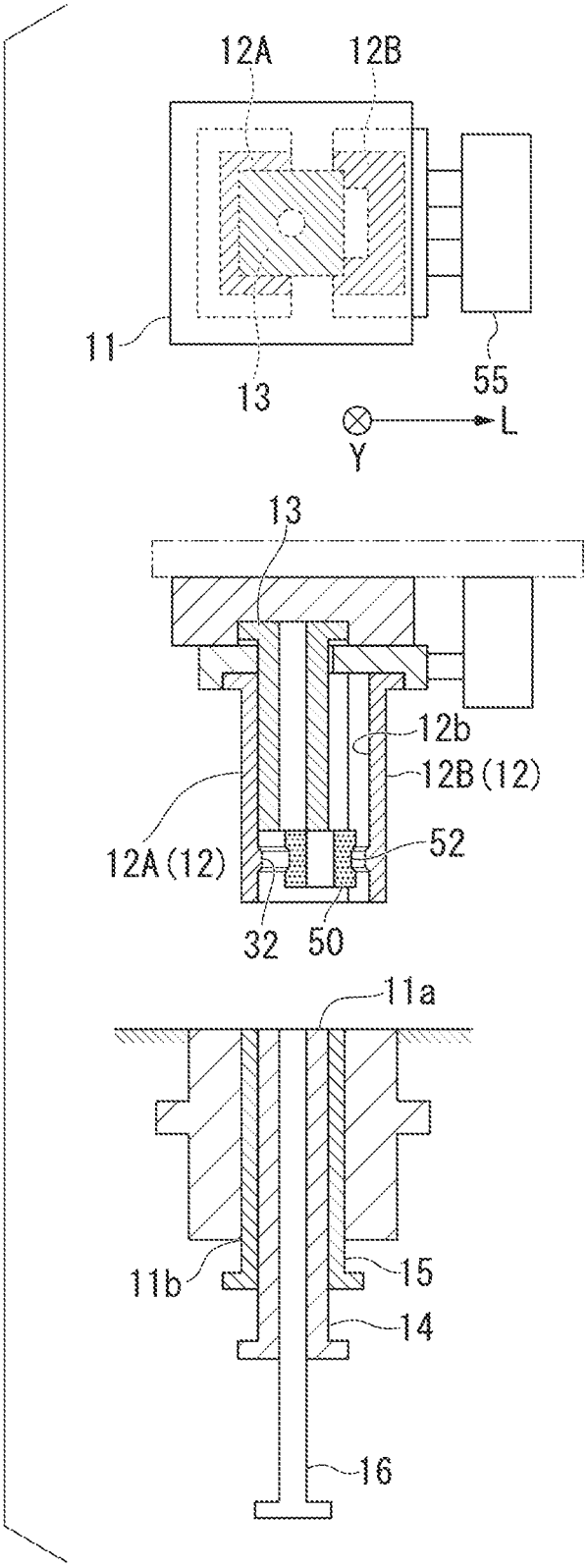
FIG. 7B is a side sectional view and a top sectional view showing the molding method related to the embodiment of the invention.

Next, as shown in FIG. 7B, the second-die split body 12A and the second-die split body 12B that constitute the second die 12 are separated from each other. Specifically, the second-die split body 12B is moved in the direction intersecting the insertion/removal direction Y, for example, the horizontal direction by, for example, a die moving device 55 or the like in a state where the second-die split body 12A is fixed. In this way, by moving the second-die split body 12A and the second-die split body 12B constituting the second die 12 relative to each other in the horizontal direction L, the green compact 50 (refer to FIG. 5) can be released from the second die 12 without damaging the groove 52 (refer to FIG. 5) that is the undercut shape part extending (recessed) in the direction intersecting the insertion/removal direction Y.

The green compact 50 including the groove 52 that is the undercut shape part can be molded by the above-described steps.

As described above, according to the molding die and the molding method of the invention, simply by inserting the second die 12 having the undercut molding part 32 into the through-hole 22 of the first die 11 to perform molding, a high-accuracy undercut shape part (the groove 52 in the present embodiment) can be easily molded to the entire circumference of the side surface of the green compact (molded body) 50.

The second die 12 consists of the second-die split bodies 12A and 12B capable of being split from each other, and the second-die split body 12A and the second-die split body 12B are split in a direction different from the insertion/removal direction Y, for example, the horizontal direction L after the molding of the green compact 50. Thereby, the green compact 50 can be easily released from the second die 12 without damaging the groove 52 that is the undercut shape part, and the green compact 50 with a high-accuracy undercut shape can be formed.

Additionally, the powder W (molding object) is introduced into the through-hole 22 of the first die 11 in advance and then, the second die 12 is inserted into the through-hole 22 of the first die 11 to compress the molding object in a state where the second die 12 is attached to the first punch 13. Thereby, it is possible to mold the undercut shape part in the molded body without any positional deviation and with high accuracy irrespective of the compression rate of the molding object. Therefore, it is possible to easily obtain the molded body in which the undercut shape part is formed with high accuracy.

Additionally, in the molding die 10 of the invention, the second die 12 having the undercut molding part 32 is inserted into the first die 11 so that the first die 11 is brought into close contact with the outer surface 12*a* of this second die 12, and then the powder W is compressed. Thereby, the close contact between splitting surfaces of the second-die split body 12A and the second-die split body 12B that constitute the second die 12 can be enhanced. Accordingly, there is no case where powder enters the splitting surfaces of the second-die split body 12A and the second-die split body 12B and burrs are generated in the green compact (molded body) 50, and as a result, an accurate green compact (molded body) 50 can be obtained.

Additionally, as in the molding die 10 of the invention, the second die 12 having the undercut molding part 32 is inserted into the first die 11 so that the first die 11 is brought into close contact with the outer surface 12*a* of the second die 12. Thereby, damage of the second die 12 to which strong pressure is applied at the time of compression can be prevented.

In the molding die and the molding method of the above-described embodiment, the second die 12 is formed so as to be splittable into two bodies in the horizontal direction L. However, in the case where the second die 12 consists of three or more splittable bodies and splitting directions of the respective split bodies are changed after molding, a green compact including an undercut shape including a plurality of types of alternate projections and depressions of which directions intersecting the insertion/removal direction Y are different can be molded. For example, the second die 12 may be split into two in the horizontal direction L and then split into two in the insertion/removal direction Y.

Additionally, in the molding die and the molding method of the above-described embodiment, an example has been shown in which the green compact that is an example of the molded body is obtained using a powder material as the molding object. However, the molding object is not limited to the powder. For example, the invention is completely similarly applicable to so-called sizing in which a coarsely molded solid object is used as the molding object and this solid object is introduced into the cavity P of the molding die of the invention and molded in a predetermined shape.

Additionally, besides the powder or the coarsely molded solid object, those of various forms, such as aggregates and granules, can be used as the molding object.

In the above-described embodiment, the substantially rectangular parallelepiped-shaped green compact is an exemplary example of the green compact (molded body) 50. However, the molded body obtained by the molding die and molding method of the invention is not limited to one having such a shape. Hereinafter, an exemplary example of some of molded bodies obtained by the molding die and the molding method of the invention will be described with reference to the drawings.

Figure 8:
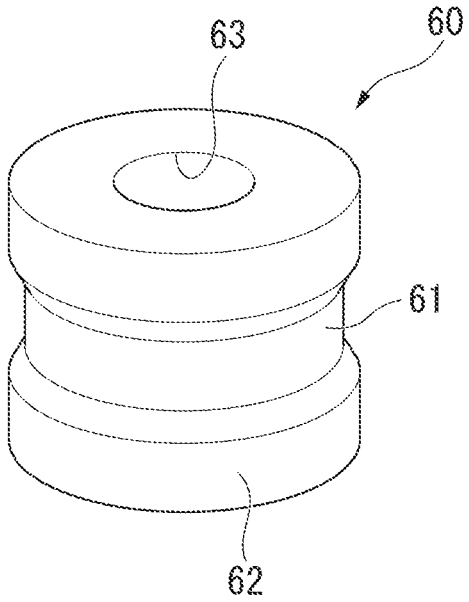
FIG. 8 is an external perspective view showing an example of the shape of a molded body.

In a molded body 60 shown in FIG. 8, the outer shape thereof is a substantially cylindrical shape, and a groove 61 serving as the undercut shape part and having a trapezoidal cross-section is formed over the entire circumference of a circumferential side surface 62. Additionally, a through-hole 63 is formed at a center portion.

Figure 9A:
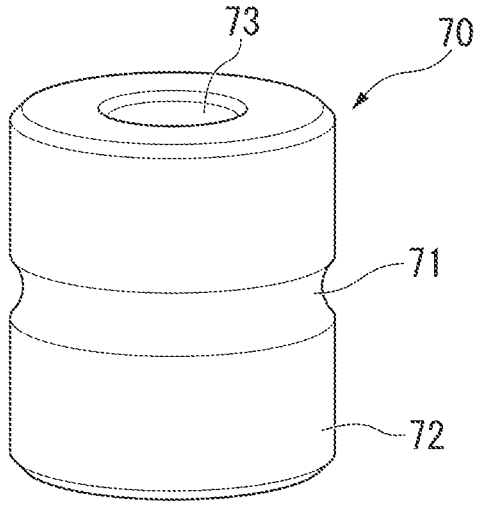
FIG. 9A is an external perspective view showing an example of the shape of a molded body.

In a molded body 70 shown in FIG. 9A, the outer shape thereof is a substantially cylindrical shape, and one groove 71 serving as the undercut shape part and having a semicircular cross-section is formed over the entire circumference of a circumferential side surface 72. Additionally, a through-hole 73 is formed at a center portion.

Figure 9B:
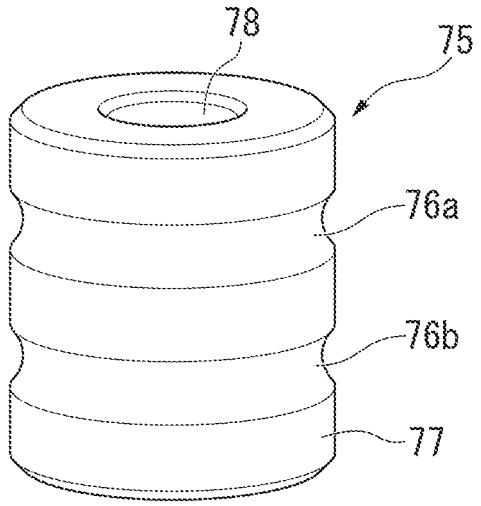
FIG. 9B is an external perspective view showing an example of the shape of a molded body.

In a molded body 75 shown in FIG. 9B, the outer shape thereof is a substantially cylindrical shape, and two grooves 76*a* and 76*b* serving as the undercut shape part and having a semicircular cross-section are formed parallel to each other over the entire circumference of a circumferential side surface 77. Additionally, a through-hole 78 is formed at a center portion.

Figure 9C:
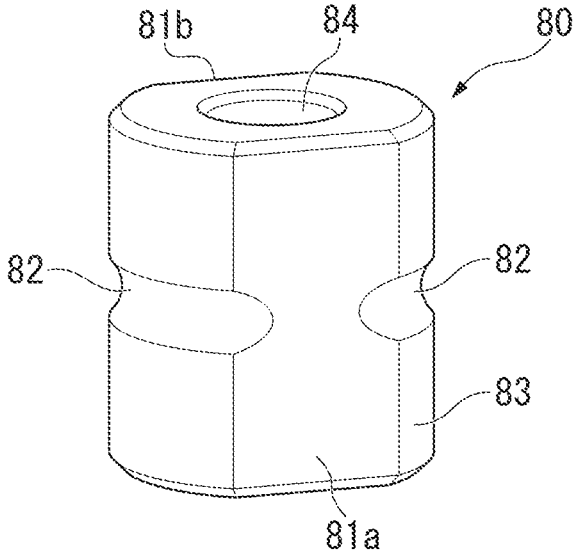
FIG. 9C is an external perspective view showing an example of the shape of a molded body.

In a molded body 80 shown in FIG. 9C, the outer shape thereof is a substantially cylindrical shape, and flat surfaces 81*a* and 81*b* facing each other are formed. A groove 82 serving as the undercut shape part and having a semicircular cross-section is formed in the portion of the circumferential side surface 83 excluding the flat surfaces 81*a* and 81*b*. Additionally, a through-hole 84 is formed at a center portion.

Figure 10A:
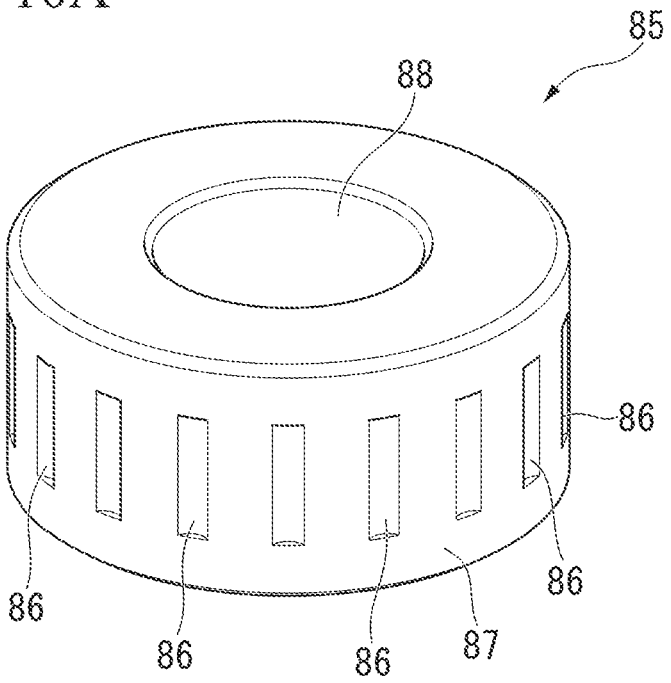
FIG. 10A is an external perspective view showing an example of the shape of a molded body.

In a molded body 85 shown in FIG. 10A, the outer shape thereof is a substantially cylindrical shape, and a plurality of rectangular grooves 86 serving as the undercut shape part are formed at predetermined intervals over the entire circumference of a circumferential side surface 87. Additionally, a through-hole 88 is formed at a center portion.

Figure 10B:
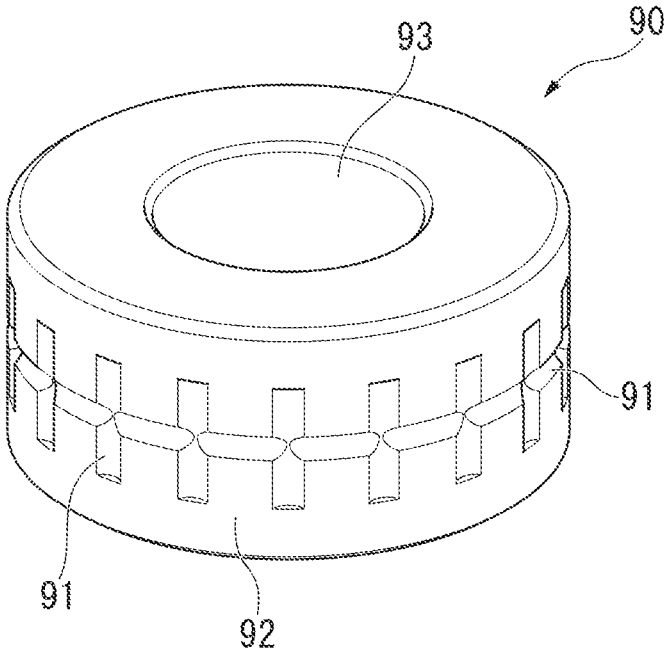
FIG. 10B is an external perspective view showing an example of the shape of a molded body.

In a molded body 90 shown in FIG. 10B, the outer shape thereof is a substantially cylindrical shape, and a groove 91 serving as the undercut shape part and having a shape in which a plurality of cross-shaped grooves are connected together is formed over the entire circumference of a circumferential side surface 92. Additionally, a through-hole 93 is formed at a center portion.

Figure 11A:
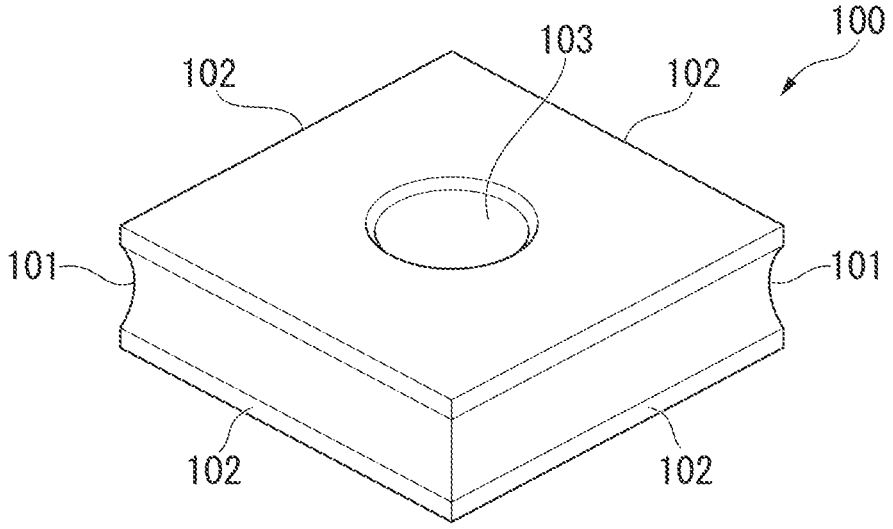
FIG. 11A is an external perspective view showing an example of the shape of a molded body.

In a molded body 100 shown in FIG. 11A, the outer shape thereof is a square, substantially plate shape, and a groove 101 serving as the undercut shape part and having a semicircular cross-section is formed over the entire circumference so as to straddle four circumferential side surfaces 102. Additionally, a through-hole 103 is formed at a center portion.

Figure 11B:
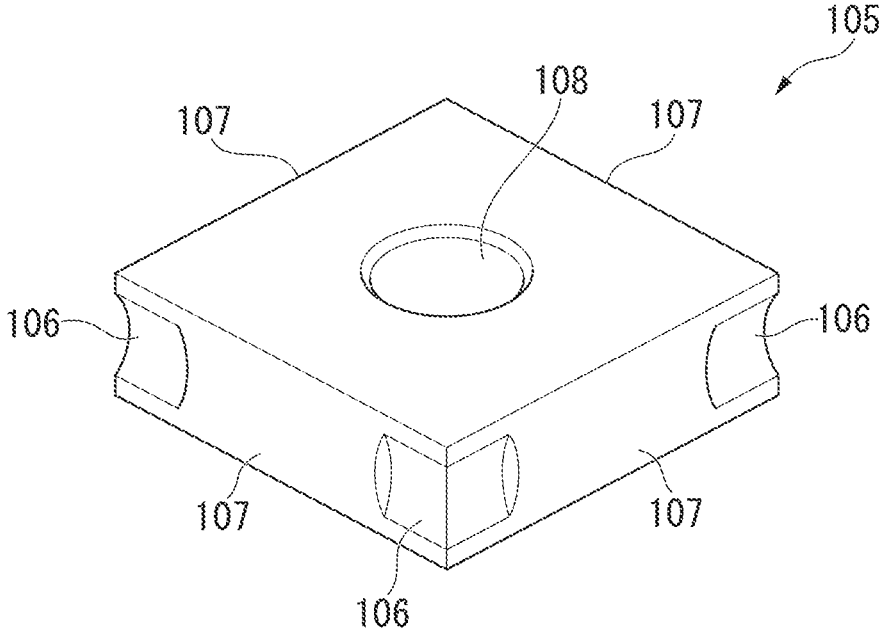
FIG. 11B is an external perspective view showing an example of the shape of a molded body.

In a molded body 105 shown in FIG. 11B, the outer shape thereof is a square, substantially plate shape, and grooves 106 serving as the undercut shape part and having a semicircular cross-section are respectively formed at four corner parts where four circumferential side surfaces 107 intersect each other. Additionally, a through-hole 108 is formed at a center portion.

The respective shapes of the molded bodies listed above are merely examples, and do not limit the shapes of the molded bodies obtained by the molding die and the molding method of the invention.

Although the several embodiments of the invention have been described above, these embodiments have been presented as examples only and are not intended to limit the scope of the invention. These embodiments can be implemented in other various forms, and various omissions, substitutions, and alternations can be made without departing from the features of the invention. These embodiments and modifications thereof are included in the scope and the features of the invention as well as being included in the invention set forth the claims and the equivalent range thereof.

INDUSTRIAL APPLICABILITY

According to the molding die of the invention and the molding method using this, the undercut shape part can be molded without any positional deviation and with high accuracy.

EXPLANATION OF REFERENCE SIGNS

10: MOLDING DIE
11: FIRST DIE
12: SECOND DIE
13: FIRST PUNCH
14: SECOND PUNCH
15: THIRD PUNCH
16: CORE ROD
22: THROUGH-HOLE
22*a* to 22*d*: INNER SURFACE
50, 60, 70, 75, 80, 85, 90, 100, 105: GREEN COMPACT (MOLDED BODY)
Y: INSERTION/REMOVAL DIRECTION (COMPRESSION DIRECTION)
P: CAVITY
W: POWDER (MOLDING OBJECT)

The invention claimed is:

1. A molding die comprising:

a first die having a through-hole and an opening at one end of the through-hole;

a second die that is configured to be inserted into the through-hole from the opening in an insertion/removal direction of the second die and is movable relative to the first die; and a first punch and a second punch each insertable into the through-hole, wherein a cavity is formed in the through-hole, said cavity being surrounded by an inner wall surface of the second die, a pressing surface of the first punch and a pressing surface of the second punch to compression-mold a molding object, wherein an undercut molding part is formed in the inner wall surface of the second die facing the cavity and includes an uneven shape portion extending in a direction intersecting the insertion/removal direction of the second die, wherein the second die is formed so as to be splittable into two or more split bodies, wherein the undercut molding part is configured to provide an undercut shape to a green compact, wherein the uneven shape portion represents a shape that protrudes or is indented by a certain angle from the insertion/removal direction of the second die, and wherein the second die and the first punch are configured such that the first punch is fitted into the second die, and that the first punch and the second die are simultaneously inserted into the through-hole from the opening of the first die.

2. The molding die according to claim 1, further comprising:

a third punch outside the second punch, wherein the third punch is movable relative to the second punch and is insertable into and removable from the through-hole so as to be in contact with the second die at a tip thereof and in contact with an inner surface of the through-hole.

3. The molding die according to claim 1, further comprising:

a core rod insertable into the cavity.

4. The molding die according to claim 1, wherein the molding object is powder.

5. The molding die according to claim 1, wherein the insertion/removal direction is a compression direction with respect to the cavity.

6. A molding method using the molding die according to claim 1, the molding method comprising at least:

an introduction step of introducing the molding object into the through-hole in a state where the second punch is inserted in an insertion/removal direction from one side of the through-hole;

an insertion step of simultaneously inserting the first punch and the second die from the other side of the through-hole;

a compression step of bringing the first punch and the second punch close to each other to compression-mold the molding object within the cavity to mold a molded body; and an extraction step of extracting the molded body from the molding die.

7. The molding method according to claim 6, wherein the extraction step is a step of pulling out the first punch, the second die, and the molded body from the through-hole, and then splitting the second die in a direction intersecting the insertion/removal direction to remove the molded body from the second die.

8. A molding die comprising:

a first die having a through-hole and an opening at one end of the through-hole;

a second die that is configured to be inserted into the through-hole from the opening in an insertion/removal direction of the second die and is movable relative to the first die; and a first punch and a second punch each insertable into the through-hole, wherein a cavity is formed in the through-hole, said cavity being surrounded by an inner wall surface of the second die, a pressing surface of the first punch and a pressing surface of the second punch to compression-mold a molding object, wherein an undercut molding part is formed in the inner wall surface of the second die facing the cavity, wherein the second die is formed so as to be splittable into two or more split bodies, and wherein the second die and the first punch are configured such that the first punch is fitted into the second die, and the first punch and the second die are simultaneously inserted into the through-hole from the opening of the first die.

* * * * *